US009004727B2

(12) United States Patent
Chudy

(10) Patent No.: US 9,004,727 B2
(45) Date of Patent: Apr. 14, 2015

(54) INTERCHANGEABLE REFLECTORS FOR LIGHT DEVICES

(71) Applicant: Snap-on Incorporated, Kenosha, WI (US)

(72) Inventor: Frederick C. Chudy, Greenfield, WI (US)

(73) Assignee: Snap-on Incorporated, Kenosha, WI (US)

( * ) Notice: Subject to any disclaimer, the term of this patent is extended or adjusted under 35 U.S.C. 154(b) by 54 days.

(21) Appl. No.: 13/741,979

(22) Filed: Jan. 15, 2013

(65) Prior Publication Data

US 2014/0198493 A1 Jul. 17, 2014

(51) Int. Cl.

| | |
|---|---|
| ***F21V 7/00*** | (2006.01) |
| ***F21V 7/07*** | (2006.01) |
| ***F21V 7/06*** | (2006.01) |
| ***F21L 4/02*** | (2006.01) |
| ***F21V 17/00*** | (2006.01) |
| *F21L 4/04* | (2006.01) |
| *F21V 17/10* | (2006.01) |
| *F21Y 101/02* | (2006.01) |

(52) U.S. Cl.

CPC ..... *F21L 4/027* (2013.01); *Y10T 29/49826* (2015.01); *F21L 4/045* (2013.01); *F21V 7/0075* (2013.01); *F21V 7/06* (2013.01); *F21V 17/002* (2013.01); *F21V 17/10* (2013.01); *F21Y 2101/02* (2013.01)

(58) Field of Classification Search

CPC ..... F21V 7/0025; F21V 7/09
USPC ..... 362/341, 346, 296.01, 296.05, 296.07, 362/296.08, 304–305
See application file for complete search history.

(56) References Cited

U.S. PATENT DOCUMENTS

| | | | | |
|---|---|---|---|---|
| 1,424,561 | A | 8/1922 | Dunn | |
| 1,478,898 | A * | 12/1923 | Hachman | 362/291 |
| 1,688,598 | A | 10/1928 | Riley | |
| 2,126,650 | A * | 8/1938 | Matera | 362/302 |
| 2,251,920 | A | 8/1941 | Deloken | |
| 2,676,312 | A * | 4/1954 | Dillon | 362/304 |
| 2,907,873 | A | 10/1959 | Smith | |
| 3,319,062 | A | 5/1967 | Falk | |
| 3,413,462 | A | 11/1968 | Spero | |
| 3,679,892 | A | 7/1972 | Shearer | |
| 3,892,960 | A | 7/1975 | Heritage | |
| 4,096,555 | A * | 6/1978 | Lasker | 362/302 |

(Continued)

OTHER PUBLICATIONS

Canadian Combined Search and Examination Report, dated Jan. 20, 2014; 5 pages.

*Primary Examiner* — Robert May
*Assistant Examiner* — Bryon T Gyllstrom
(74) *Attorney, Agent, or Firm* — Seyfarth Shaw LLP

(57) ABSTRACT

A reflector device for a light source device having a light emitter, wherein the reflector device includes first and second reflectors. The first reflector has a first reflector surface adapted to produce a first light beam and the second reflector has a second reflector surface different from the first reflector surface and which is adapted to produce a second light beam different than the first light beam. The second reflector is adapted to be removably coupled to the first reflector such that both reflectors are coupled to the light source device at the same time. This allows a user to change a beam pattern of the light source between a first, default, beam pattern and a second beam pattern by interchanging the second reflector on the light source.

16 Claims, 2 Drawing Sheets

(56) References Cited

U.S. PATENT DOCUMENTS

| | | | | |
|---|---|---|---|---|
| 5,463,538 | A | 10/1995 | Womack | |
| 5,678,921 | A * | 10/1997 | Kish et al. | 362/205 |
| 6,036,338 | A | 3/2000 | Gordin | |
| 6,203,176 | B1 | 3/2001 | Gordin | |
| 6,313,869 | B1 | 11/2001 | Hyp et al. | |
| 7,188,975 | B2 * | 3/2007 | Gorres | 362/297 |
| 7,644,596 | B2 * | 1/2010 | Ookahara et al. | 65/61 |
| 7,780,316 | B2 * | 8/2010 | Engel | 362/299 |
| 7,841,735 | B2 | 11/2010 | Newton et al. | |
| 8,083,364 | B2 * | 12/2011 | Allen | 362/84 |
| 2008/0013308 | A1 * | 1/2008 | Kang et al. | 362/205 |
| 2008/0272714 | A1 | 11/2008 | Noble et al. | |
| 2009/0296367 | A1 * | 12/2009 | Sekine et al. | 362/84 |
| 2010/0149819 | A1 * | 6/2010 | Oon et al. | 362/296.07 |
| 2011/0140633 | A1 * | 6/2011 | Archenhold | 315/291 |

* cited by examiner

INTERCHANGEABLE REFLECTORS FOR LIGHT DEVICES

TECHNICAL FIELD OF THE INVENTION

The present application relates to reflectors for light source devices, such as flash lights or spot lights. In particular, the present application relates to interchangeable reflectors adapted to reflect light differently and that are each couplable to a single light source device.

BACKGROUND OF THE INVENTION

There are numerous light source devices on the market, such as flashlights, work lights, and lamps. In general, these light source devices include a light bulb mounted in a reflector and a lens disposed over the light bulb. The reflector is adapted to dissipate light, focus the light into a beam pattern, and protect the internal components of the device. The beam pattern is predetermined by the reflector, typically by the shape, size and surface material of the reflector, and cannot be altered by a user of the light source device.

SUMMARY OF THE INVENTION

The present application discloses devices and methods for altering a light beam pattern by using interchangeable reflectors couplable to a single light source device. For example, a reflector device may include a first reflector that produces a first beam pattern and a second reflector that produces a second beam pattern different than the first beam pattern. The second reflector can be selectively overlaid on top of and removed from the first reflector such that the first and second reflectors are couplable to the same light source device. As opposed to a conventional light source, in an embodiment, the reflector device can include no face plate or bezel. Accordingly, the second reflector can be disposed within the first reflector, i.e., the external surface of the second reflector can be disposed adjacent to the reflector surface of the first reflector. It is to be understood that while first and second reflectors are described herein, any number of reflectors can be used.

In an embodiment, die reflector device includes first and second reflectors. The first reflector is adapted to be coupled to a light source device and has a first reflector surface extending from a first peripheral portion to a first aperture, wherein the first aperture is concentric about an axis. In such a manner, the first reflector produces a first light beam from the light source device. The second reflector is adapted to be removably coupled to the first reflector and has a second reflector surface different than the first reflector surface. The second reflector surface extends from a second peripheral portion to a second aperture, and the second aperture is concentric about the axis. When coupled to the light source device, the second reflector produces a second light beam different than the first light beam.

In another illustrative embodiment, a lighting device includes a head portion including a light source. A first reflector is adapted to be disposed in the head portion, and has a first reflector surface extending from a first peripheral portion to a first aperture and is adapted to produce a first light beam with the light source. The first aperture is concentric about an axis and adapted to receive the light source. A second reflector is adapted to be overlaid onto the first reflector, and has a second reflector surface different from the first reflector surface and is thus adapted to produce a second light beam with the light source. The second reflector surface extends from a second peripheral portion to a second aperture, and the second aperture is concentric about the axis and adapted to receive the light source. Additionally a bezel is adapted to couple to the head portion.

BRIEF DESCRIPTION OF THE DRAWINGS

Embodiments of devices and methods are illustrated in the figures of the accompanying drawings which are meant to be exemplary and not limiting, in which like references are intended to refer to like or corresponding parts, and in which.

DETAILED DESCRIPTION OF THE EMBODIMENTS

Detailed embodiments of devices and methods are disclosed herein. However, it is to be understood that the disclosed embodiments are merely exemplary of the devices and methods, which may be embodied in various forms. Therefore, specific functional details disclosed herein are not to be interpreted as limiting, but merely as a basis for the claims and as a representative example for teaching one skilled in the art to variously employ the present disclosure.

The present application relates to a reflector device for a light source device that allows a user to change the beam pattern of the light source device to suit a particular need. The reflector device includes a first reflector adapted to produce a first beam pattern and a second reflector adapted to produce a second beam pattern different from the first beam pattern. In an embodiment, the first reflector is a default reflector that is intended to be coupled to the light source device a majority of the time, and the second reflector is adapted to overly and/or be inserted into the first reflector such that the first and second reflectors are each coupled to the same light source device at the same time, therefore negating the need to remove the first reflector. The second reflector may also be removed from the light source device and interchanged with a third reflector having different light dissipation characteristics to suit the particular need of the user. In an embodiment, the third reflector can be disposed within the first reflector, i.e., the external surface of the third reflector can be disposed adjacent to the reflector surface of the first reflector. It is to be understood, that while the present application is described as having first and second reflectors, any number of reflectors can be used.

Figure 1:
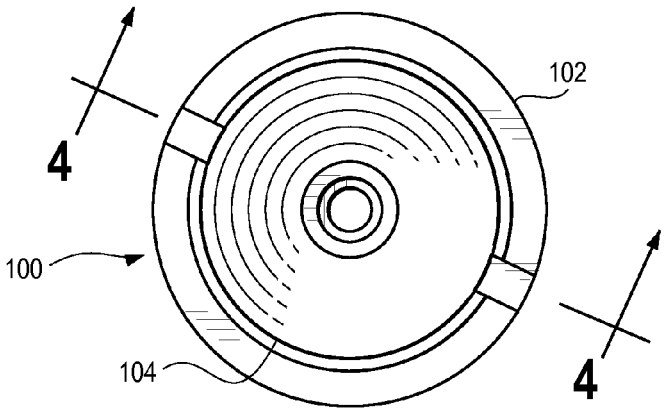
FIG. 1 is a top view of a reflector device in accordance with an embodiment of the present application, with a second reflector coupled to a first reflector.
Figure 2:
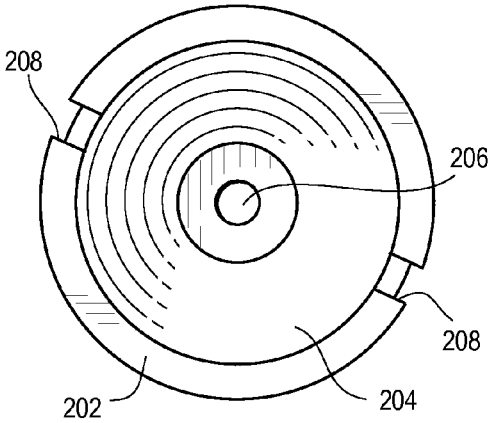
FIG. 2 is a top view of a first reflector of a reflector device in accordance with an embodiment of the present application.
Figure 3:
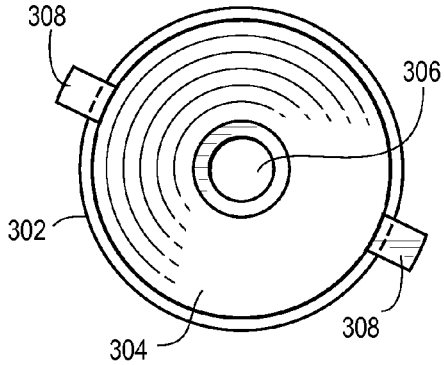
FIG. 3 is a top view of a second reflector of the reflector device in accordance with an embodiment of the present application.

FIGS. 1-3 illustrate top views of an embodiment of a reflector device 100. As illustrated in FIG. 1 the reflector device 100 includes a first reflector 102 adapted to produce a first light beam pattern and a second reflector 104 adapted to produce a second light beam pattern, wherein the second reflector 104 is also adapted to be removably coupled to the first reflector 102. The reflector device 100 is adapted to be disposed in a light source device, such as, for example, a flash light, and allows a user to selectively change the light beam pattern of the light source device by utilizing either of the first or second reflectors 102, 104 with the light source device. As shown, and unlike conventional light sources, the first reflector 102 has no bezel or cover plate. Rather, the second reflector 104 can be disposed within the first reflector 102 in a compact manner.

Referring to FIG. 2, the first reflector 102 includes a first peripheral portion 202, a first reflector surface 204 extending from the first peripheral portion 202, and a first aperture 206 disposed in the first reflector surface 204. The first peripheral portion 202 may be circular and include one or more notches 208. The notches 208 can receive a portion of the second reflector 104, for example, protrusions 308, as described below. As illustrated, the notches 208 are disposed in the first peripheral portion 202 opposite one another. However, the notches 208 may be disposed in any portion of the first peripheral portion 202. Moreover, any number of notches 208 may be used.

The first reflector 102 may have a substantially frustoconical cross-sectional shape and includes a first reflector surface 204 adapted to reflect light in a first light beam pattern when coupled to a light source device, depending on the size, shape and/or type of material used for the first reflector surface 204, and that extends from the first peripheral portion 202 to the first aperture 206. The first aperture 206 is disposed substantially in an axial center of the first reflector 102, and may be concentric about an axis extending through the first reflector 102 perpendicular to a plane of the first aperture 206. The first aperture 206 may have a first sue adapted to receive or be disposed over at least a portion of a light source, such as a light bulb, light emitting diode (LED), or other light-emitting source. In an embodiment, the first aperture 206 has a diameter of about six millimeters.

Referring to FIG. 3, the second reflector 104 may have a substantially frustoconical cross-sectional shape slightly smaller than the first reflector 102, so that the second reflector 104 can sit inside of the first reflector 102. The second reflector 104 includes a second reflector surface 304 adapted to reflect light in a second light beam pattern when coupled to a light source device, depending on the size, shape and/or type of material used for the second reflector surface 304, which is different from the first light beam pattern. The second reflector 104 includes a second peripheral portion 302 and a second reflector surface 304 extending from the second peripheral portion 302 to a second aperture 306. The second aperture 306 may be disposed substantially in an axial center of the second reflector 104, and may be concentric about an axis extending through the second reflector 104 perpendicular to a plane of the second aperture 306. The second aperture 306 may have a size equal to or greater than the sue of the first aperture 206 and is adapted to receive or be disposed over the light source. In an embodiment, the second aperture 306 has a diameter of about seven millimeters.

The second reflector 104 may include one or more protrusions 308 which are adapted to respectively align with and to be received in notches 208. As illustrated, the protrusions 308 radially extend from the second peripheral portion 302 and are disposed opposite one another. However, the protrusions 308 may be disposed in any portion of the second peripheral portion 302 so long as the protrusions 308 respectively align with the notches 208.

Although the first reflector 102 and the second reflector 104 are described as including first and second apertures 206 and 306, the first reflector 102 and the second reflector 104 may each include more than one aperture. For example, where the light source device includes multiple LEDs, the first and second reflectors 102 and 104 may include multiple first and second apertures 206 and 306 corresponding to the number of LEDs of the light source device.

Figure 4:
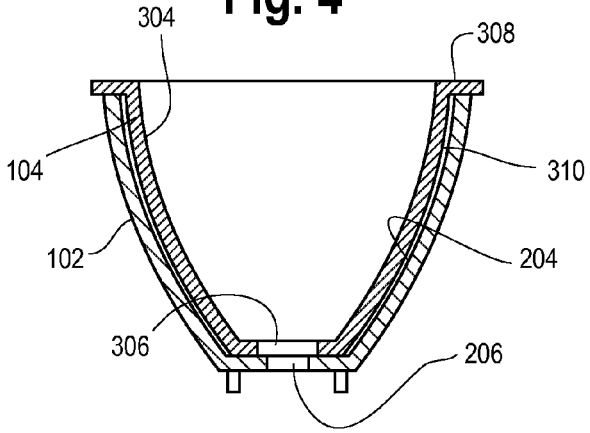
FIG. 4 is a cross-sectional view of the reflector device of the present application of FIG. 1 taken along line 4-4.

FIG. 4 illustrates a cross-sectional view of the reflector device 100. As illustrated, the first and second reflectors 102 and 104 are substantially parabolic reflectors having frustoconical cross-sections, and an exterior surface 310 of the second reflector 104 is disposed overlying the first reflector surface 204 of the first reflector 102. The protrusions 308 of the second reflector 104 are also respectively received within the notches 208 of the first reflector surface 204. The engagement of the protrusions 308 and the notches 208 serve to hold the first and second reflectors 102 and 104 in alignment with one another and restrict movement of the first and second reflectors 102 and 104 with respect to one another.

In one embodiment, the second reflector 104 may be coupled to the first reflector 102 by disposing the protrusions 308 within the notches 208 of the first reflector 102 and rotating the second reflector 104 with respect to the first reflector 102. In this embodiment, the protrusions 308 may be disposed under at least a portion of the first peripheral portion 202 of the first reflector 102 to couple the second reflector 104 to the first reflector 102.

Although the first reflector 102 and the second reflector 104 are described as including notches 208 and protrusions 308, respectively, the first reflector 102 may include protrusions and the second reflector 104 may include mating notches. For example, the first reflector 102 may include protrusions that project inwardly and the second reflector 104 may include notches that matingly engage the protrusions. However, the first 102 and second 104 reflectors can be releasably coupled together using any known means. For example, the first reflector 102 may be coupled to the second reflector 104 using removable fasteners, resilient prongs and corresponding apertures, mating screw threads, magnets, Velcro®, and any other coupling mechanism or combinations thereof.

In an embodiment, the first reflector surface 204 and the second reflector surface 304 have different reflective surfaces that focus light emitted by a light source of the light source device into different respective first and second light beam patterns. For example, the first reflector surface 204 may be adapted to produce a first light beam pattern like a flood light to illuminate a large area, and die second reflector surface 304 may be adapted to produce a second light beam pattern to focus narrowly over a distance.

In general, the shape, size, and/or material of the reflective surface of the reflector that determines the beam pattern. This is due to differences in how light is reflected by different reflectors. For example, a reflector having a mirror surface may create a light beam that throws light over a distance. In contrast, a reflector having an orange peel surface or textured surface may scatter light, thereby creating a light beam that floods to illuminate an area. The scattering of the light by the textured surface may also produce a smoother, more artifact free beam pattern, compared to the mirror surface, but may reduce the distance of the throw of the light beam.

The first and second reflector surfaces 204 and 304 may each be, or alternatively be adapted to throw light over a distance, to flood light to illuminate a large area, and/or to increase or decrease artifacts in the light beam. The first and second reflector surfaces 204 and 304 may also have any type of reflective surface adapted to focus light into a particular beam pattern, for example, including but not limited to an un-textured surface and a textured surface. Some examples of such surfaces include a mirror surface, a smooth surface, a light orange peel surface, a medium orange peel surface, a heavy orange peel surface, a stippled surface, and other surfaces of the type.

Although the first and second reflectors 102 and 104 are illustrated as parabolic reflectors, the first and second reflectors 102 and 104 may be any type of reflector, for example, including but not limited to, a parabolic reflector, conical reflector, concave reflector, ellipsoidal reflector, and other types of reflectors. Further, although the first and second reflectors 102 and 104 are described and illustrated as having circular first and second peripheral portions 202 and 302, the first and second peripheral portions 202 and 302 may be any shape, for example, including but not limited to rectangular, square, triangular, polygonal, and other shapes of the type.

Figure 5:
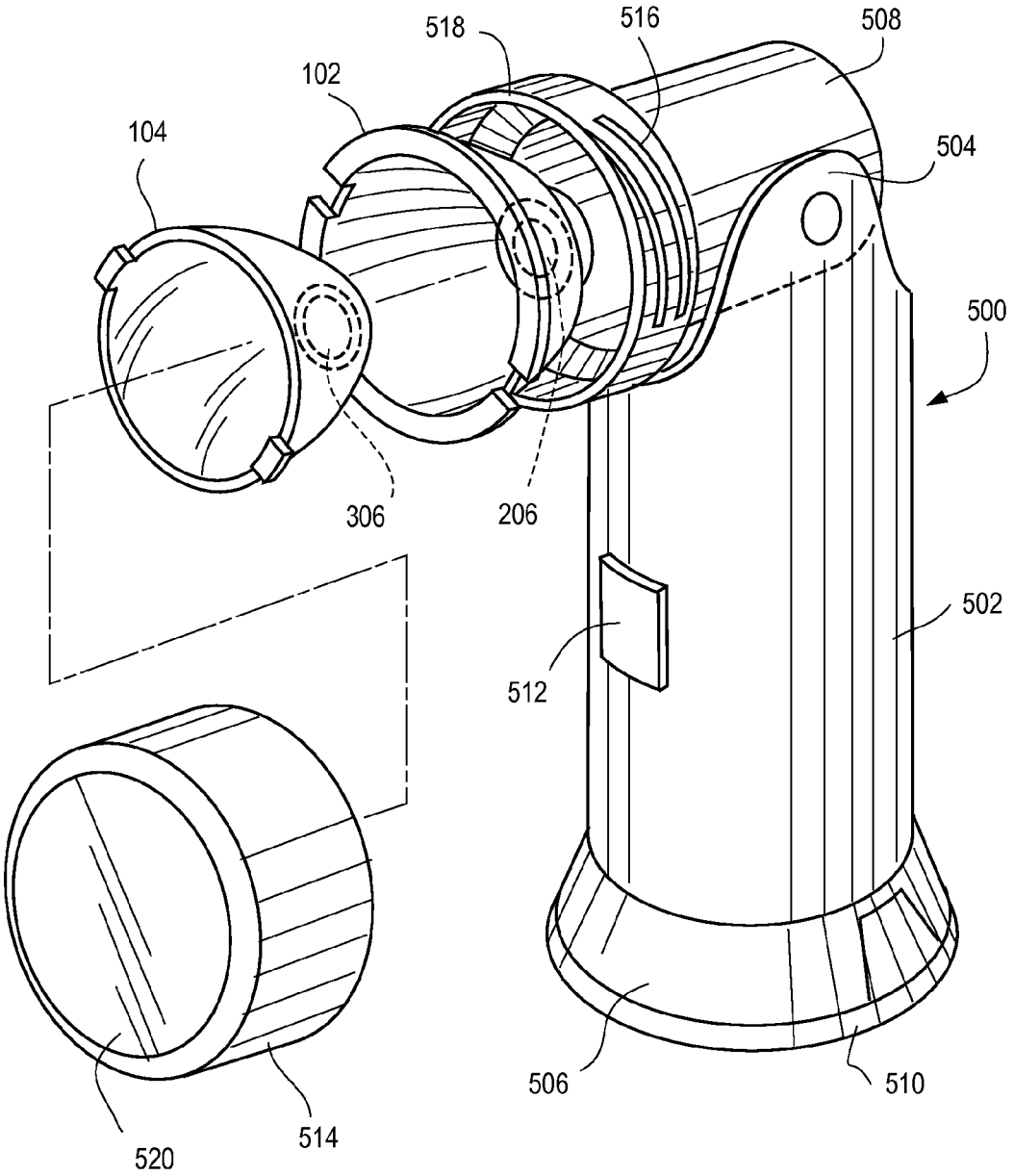
FIG. 5 is an exploded, perspective side view of a light source device including a reflector device in accordance with an embodiment of the present application.

An example of a light source device, a work light 500, including the reflector device according to an illustrative embodiment is described with reference to FIG. 5. The work light 500 includes a housing 502 having a first end 504 and a second end 506, a head portion 508 or working portion coupled to the first end 504, a power source 510 adapted to be received in the housing 502 and couple to the second end 506, and a switch 512 adapted to activate and deactivate voltage or current flow from the power source 510 to a light emitter, for example, a light bulb or light emitting diode (LED), disposed on the head portion 508 when in an ON position and an OFF position, respectively.

In an embodiment, the head portion 508 includes a bezel 514 adapted to threadably couple to the head portion 508. For example, the bezel 514 may include internal threads adapted to threadably engage external threads 516 on an end portion 518 of the head portion 508. The first reflector 102 is disposed in the head portion 508 such that a light source extends through the first aperture 206 and into the first reflector 102. The second reflector 104 is disposed in the head portion 508 overlying the first reflector 102 such that the light source extends through the second aperture 306 and into the second reflector 104. In an embodiment, the first reflector 102 may be fixed in the head portion 508, and the second reflector 104 is removable.

The bezel 514 may be threaded onto the head portion 508 to secure the first and second reflectors 102 and 140 in the head portion 508. A transparent lens 520 may be disposed in the bezel 514 to protect the first reflector 102, the second reflector 104, and the light source from damage or water. The head portion 508 may also be adapted to pivot or rotate from vertical alignment with the housing 502.

To interchange or add and remove the second reflector 104 to and from the work light 500 to alter the beam pattern, the bezel 514 may be removed from the head portion 508, providing access to an internal portion of the head portion 508. The second reflector 104 may then be added to or removed from the work light 500, and the bezel 514 threaded back onto the head portion 508.

Although the reflector device is described as being implemented in a work light, it should be appreciated by those skilled in the art that the reflector device may be implemented within a number of different light source devices, including but not limited to work lights, flashlights, interior lighting and exterior lighting of residences, and other light sources.

By incorporating multiple removable reflectors that may be overlaid onto one another, the reflector device can provide the user with a number of different beam pattern options that the user can choose from.

Although the devices and methods have been described and illustrated in connection with certain embodiments, many variations and modifications will be evident to those skilled in the art and may be made without departing from the spirit and scope of the present disclosure. The present disclosure is thus not to be limited to the precise details of methodology or construction set forth above as such variations and modification are intended to be included within the scope of the present disclosure.

What is claimed is:

1. A reflector device for a light source having a light emitter, comprising:

a first reflector adapted to be coupled to the light source and having:

a first reflector surface adapted to reflect light from the light emitter as a first light beam;

a first peripheral portion extending at least partially around a periphery of the first reflector surface and including first and second arcuate portions defining a first notch therebetween, the first and second arcuate portions extending radially from the first peripheral portion in a direction away from the first reflector surface; and a first aperture defined in an axial center of the first reflector; and a second reflector adapted to be removably coupled to the first reflector and having:

a second reflector surface different from the first reflector surface and adapted to reflect light from the light emitter as a second light beam different from the first light beam;

a second peripheral portion extending at least partially around a periphery of the second reflector surface;

a first protrusion extending radially from the second peripheral portion in a direction away from the second reflector surface, the first protrusion adapted to matingly engage the first notch; and a second aperture disposed in an axial center of the second reflector.

2. The reflector device of claim 1, wherein the first aperture is adapted to receive the light emitter.

3. The reflector device of claim 2, wherein the second aperture is adapted to receive the light emitter.

4. The reflector device of claim 3, wherein the second aperture has a second aperture size that is larger than a first aperture size of the first aperture.

5. The reflector device of claim 1, wherein the first and second reflector surfaces are respectively selected from the group consisting of a mirror surface, a smooth surface, a light orange peel surface, a medium orange peel surface, a heavy orange peel surface, and a stippled surface.

6. The reflector device of claim 1, wherein the second reflector includes an exterior surface adapted to overly the first reflector surface of the first reflector.

7. The reflector device of claim 1, further comprising a second protrusion diametrically opposing the first protrusion and extending radially from the second peripheral portion in a direction away from the second reflector surface, wherein the first and second arcuate portions define diametrically opposing first and second notches therebetween, and wherein the first and second protrusions respectively matingly engage the first and second notches.

8. A lighting device, comprising:

a head portion including a light source having a light emitter;

a first reflector adapted to be disposed in the head portion, the first reflector having a first reflector surface adapted to reflect light from the light emitter as a first light beam, a first peripheral portion extending at least partially around a periphery of the first reflector surface and including first and second arcuate portions defining a first notch therebetween, the first and second arcuate portions extending radially from the first peripheral portion in a direction away from the first reflector surface; and a first aperture defined in an axial center of the first reflector, the first aperture adapted to receive the light emitter;

a second reflector adapted to overly the first reflector, the second reflector having a second reflector surface different from the first reflector surface and adapted to reflect light from the light emitter as a second light beam different from the first light beam, a second peripheral portion extending at least partially around a periphery of the second reflector surface, a first protrusion extending radially from the second peripheral portion in a direction away from the second reflector surface, the first protrusion adapted to matingly engage the first notch, and a second aperture defined in an axial center of the second reflector, the second aperture being adapted to receive the light emitter; and a bezel adapted to couple to the head portion.

9. The lighting device of claim 8, wherein the first and second reflectors are respectively selected from the group consisting of a parabolic reflector, a conical reflector, a concave reflector, and an ellipsoidal reflector.

10. The lighting device of claim 8, wherein the first reflector is fixed to the head portion.

11. The lighting device of claim 8, wherein the second reflector is adapted to be removed from first reflector.

12. The lighting device of claim 8, further comprising a transparent lens disposed in the bezel.

13. The lighting device of claim 8, wherein the second reflector includes an exterior surface disposed overlying the first reflector surface of the first reflector.

14. The lighting device of claim 8, further comprising a second protrusion diametrically opposing the first protrusion and extending radially from the second peripheral portion in a direction away from the second reflector surface, wherein the first and second arcuate portions define diametrically opposing first and second notches therebetween, and wherein the first and second protrusions respectively matingly engage the first and second notches.

15. A method of modifying a light beam of a light emitting device, comprising:

removing a bezel of the light emitting device to expose a first reflector disposed in the light emitting device, the first reflector having a first reflector surface adapted to reflect light emitted by the light emitting device as a first light beam pattern, a first peripheral portion extending at least partially around a periphery of the first reflector surface and having first and second arcuate portions defining a notch therebetween, the first and second arcuate portions extending radially from the first peripheral portion in a direction away from the first reflector surface;

overlying a second reflector having a second reflector surface onto the first reflector, the second reflector surface adapted to reflect the light emitted by the light emitting device as a second light beam pattern different from the first light beam pattern, the second reflector having a second peripheral portion extending at least partially around a periphery of the second reflector surface, and a protrusion extending radially from the second peripheral portion in a direction away from the second reflector surface, the protrusion adapted to mate with the notch;

mating a protrusion of the second reflector with a notch of the first reflector; and coupling the bezel to the light emitting device.

16. The method of claim 15, wherein the overlying of the second reflector includes disposing an exterior surface of the second reflector adjacent to the first reflector surface of the first reflector.

* * * * *